US010570543B2

(12) United States Patent
Schenkl

(10) Patent No.: US 10,570,543 B2
(45) Date of Patent: Feb. 25, 2020

(54) WASHING MACHINE AND METHOD OF CONTROLLING THE WASHING MACHINE

(71) Applicant: emz-Hanauer GmbH & Co. KGaA, Nabburg (DE)

(72) Inventor: Johann Schenkl, Bodenwoehr (DE)

(73) Assignee: emz-Hanauer GmbH & Co. KGaA (DE)

( * ) Notice: Subject to any disclaimer, the term of this patent is extended or adjusted under 35 U.S.C. 154(b) by 515 days.

(21) Appl. No.: 15/286,718

(22) Filed: Oct. 6, 2016

(65) Prior Publication Data

US 2018/0100259 A1 Apr. 12, 2018

(51) Int. Cl.
*D06F 33/02* (2006.01)
*D06F 37/24* (2006.01)

(52) U.S. Cl.
CPC ..... *D06F 33/02* (2013.01); *D06F 37/24* (2013.01); *D06F 2202/085* (2013.01); *D06F 2202/10* (2013.01); *D06F 2204/065* (2013.01); *D06F 2204/086* (2013.01)

(58) Field of Classification Search
CPC .... D06F 33/02; D06F 39/003; D06F 2202/10; D06F 2204/086; D06F 35/006; D06F 2202/085; D06F 2202/12; D06F 39/087
USPC ..... 68/12.04, 12.05, 12.02, 12.06, 12.27, 68/23.1, 12.21, 12.19, 207, 12.12, 12.01, 68/12.23; 8/158, 159, 137
See application file for complete search history.

(56) References Cited

U.S. PATENT DOCUMENTS 4,400,838 A * 8/1983 Steers ..... D06F 39/003 68/12.19
4,607,408 A * 8/1986 Didier ..... G01G 19/00 68/12.04
5,144,819 A * 9/1992 Hiyama ..... D06F 39/003 68/12.04
5,161,393 A * 11/1992 Payne ..... D06F 39/003 68/12.04

(Continued)

FOREIGN PATENT DOCUMENTS

CN 103290650 A 9/2013
CN 104928884 A 9/2015

(Continued)

*Primary Examiner* — David G Cormier
*Assistant Examiner* — Thomas Bucci
(74) *Attorney, Agent, or Firm* — Sarita L. Pickett, Esq.; Robert R. Deleault, Esq.; Mesmer & Deleault, PLLC

(57) ABSTRACT

A washing machine includes a machine housing, a wash drum suspended by a plurality of carrier arms, a force sensor associated with at least one carrier arm provides a signal that is representative of a force acting on the carrier arm, and a control unit connected to the force sensor. The control unit receives measurement information during each of a plurality of phases of a program run of the washing machine, that is representative of a signal profile over time of the sensor signal over at least a portion of a revolution of the wash drum, introduces a defined amount of water into the wash drum between each pair of successive phases, determines parameter information indicative of the fabric type of laundry loaded into the drum based on the measurement information obtained during the various phases, and controls the program run in dependence on the determined parameter information.

14 Claims, 6 Drawing Sheets

(56) References Cited

U.S. PATENT DOCUMENTS 5,230,228 A * 7/1993 Nakano ..... D06F 39/003 68/12.04
5,259,217 A * 11/1993 Civanelli ..... D06F 39/003 68/12.02
5,337,431 A * 8/1994 Kim ..... D06F 39/003 68/12.02
5,388,299 A * 2/1995 Lee ..... D06F 39/003 68/12.02
5,720,064 A * 2/1998 Koo ..... D06F 39/087 8/158
5,768,729 A * 6/1998 Cracraft ..... D06F 39/087 68/12.05
5,897,672 A * 4/1999 Badami ..... D06F 39/003 68/12.04
6,023,950 A * 2/2000 Battistella ..... D06F 39/003 68/12.04
6,029,298 A * 2/2000 Dausch ..... D06F 39/003 68/12.05
6,038,724 A * 3/2000 Chbat ..... D06F 39/003 68/12.04
6,065,170 A * 5/2000 Jang ..... D06F 37/203 68/12.04
6,446,291 B1 * 9/2002 Diaz Fernandez ..... D06F 13/02 68/12.05
6,460,381 B1 * 10/2002 Yoshida ..... D06F 37/203 68/12.04
6,564,413 B2 * 5/2003 Braun ..... D06F 35/007 8/159
6,637,062 B2 * 10/2003 Braun ..... D06F 23/02 8/159
6,983,657 B1 * 1/2006 Kakutani ..... D06F 37/24 73/779
7,287,292 B2 * 10/2007 Kim ..... D06F 33/02 68/12.04
7,421,752 B2 * 9/2008 Donadon ..... D06F 39/003 8/158
7,661,168 B2 * 2/2010 Kim ..... D06F 39/087 68/12.04
7,930,787 B2 * 4/2011 La Belle ..... D06F 39/087 68/12.04
8,166,590 B2 * 5/2012 Ashrafzadeh ..... D06F 39/003 68/139
8,220,292 B2 * 7/2012 Czyzewski ..... D06F 39/003 68/12.05
8,312,581 B2 * 11/2012 Pelczer ..... D06F 33/02 68/12.04
8,910,335 B2 * 12/2014 Kim ..... D06F 39/003 8/158
9,139,946 B2 * 9/2015 Dogan ..... D06F 39/003
9,243,987 B2 * 1/2016 Chanda ..... G01N 9/00
9,540,756 B2 * 1/2017 Janke ..... D06F 33/02
9,551,103 B2 * 1/2017 Goshgarian ..... D06F 39/003
9,598,808 B2 * 3/2017 Guzman ..... D06F 35/005
9,758,913 B2 * 9/2017 Obregon ..... D06F 33/02
2003/0041390 A1 * 3/2003 Kim ..... D06F 39/003 8/158
2004/0006831 A1 * 1/2004 Kim ..... D06F 13/08 8/159
2005/0016226 A1 * 1/2005 Okazaki ..... D06F 33/02 68/12.04
2005/0022564 A1 * 2/2005 Kim ..... D06F 39/003 68/12.04
2005/0125909 A1 * 6/2005 Bellinetto ..... D06F 39/003 8/158
2005/0284192 A1 * 12/2005 Altinier ..... D06F 35/007 68/12.06
2006/0107468 A1 * 5/2006 Urbanet ..... D06F 39/003 8/158
2007/0157396 A1 * 7/2007 Won ..... D06F 35/006 8/158
2007/0283508 A1 * 12/2007 Wong ..... D06F 35/006 8/149.3
2008/0120788 A1 * 5/2008 Do ..... D06F 35/006 8/159
2008/0201867 A1 * 8/2008 Bang ..... D06F 33/02 8/158
2008/0282479 A1 * 11/2008 Darby ..... D06F 39/003 8/159
2009/0106913 A1 * 4/2009 Suel, II ..... D06F 39/003 8/159
2009/0241270 A1 * 10/2009 La Belle ..... D06F 33/00 8/159
2010/0024490 A1 * 2/2010 Nieh ..... D06F 33/02 68/12.02
2010/0064445 A1 * 3/2010 Nieh ..... D06F 35/006 8/159
2010/0306927 A1 * 12/2010 Oh ..... D06F 33/02 8/137
2011/0005339 A1 * 1/2011 Ashrafzadeh ..... D06F 33/02 73/862.192
2011/0113567 A1 * 5/2011 Lee ..... D06F 39/003 8/137
2011/0126359 A1 * 6/2011 Kim ..... D06F 33/02 8/137
2011/0219551 A1 * 9/2011 Im ..... D06F 25/00 8/137
2011/0233375 A1 * 9/2011 Ortega Brena ..... D06F 37/24 248/610
2012/0005840 A1 * 1/2012 Jang ..... D06F 33/02 8/137
2012/0060299 A1 * 3/2012 Kim ..... D06F 39/003 8/137
2012/0118022 A1 * 5/2012 Ashrafzadeh ..... D06F 33/02 68/12.04
2012/0312055 A1 * 12/2012 Fagstad ..... D06F 39/005 68/12.04
2013/0091635 A1 * 4/2013 Guzman ..... D06F 35/005 8/137
2013/0125595 A1 * 5/2013 Seo ..... D06F 39/003 68/12.04
2013/0152311 A1 * 6/2013 Janke ..... D06F 33/02 8/137
2013/0185872 A1 * 7/2013 Chanda ..... D06F 13/06 8/137
2013/0312202 A1 * 11/2013 Balinski ..... D06F 33/02 8/137
2014/0096327 A1 * 4/2014 Lee ..... D06F 39/087 8/137
2014/0123403 A1 * 5/2014 Zattin ..... D06F 25/00 8/137
2014/0326067 A1 * 11/2014 Chanda ..... G01N 9/00 73/32 R
2015/0000047 A1 * 1/2015 Obregon ..... D06F 33/02 8/137
2015/0000350 A1 * 1/2015 Lee ..... D06F 37/22 68/12.04
2015/0047128 A1 * 2/2015 Goshgarian ..... D06F 39/003 8/137
2015/0113740 A1 * 4/2015 Lee ..... D06F 39/003 8/137
2015/0121631 A1 * 5/2015 Kang ..... D06F 33/02 8/137
2015/0240405 A1 * 8/2015 Kwon ..... D06F 39/085 8/137
2015/0267338 A1 9/2015 Helms et al.
2015/0267339 A1 9/2015 Schenkl
2015/0292136 A1 * 10/2015 Leonard ..... D06F 33/02 8/147
2015/0354122 A1 * 12/2015 Kwon ..... D06F 39/003 8/137
2016/0083887 A1 * 3/2016 Jang ..... D06F 33/02 8/137

(56) References Cited

U.S. PATENT DOCUMENTS

| | | | | |
|---|---|---|---|---|
| 2016/0237610 | A1* | 8/2016 | Kim | D06F 33/02 |
| 2017/0145620 | A1* | 5/2017 | Janke | D06F 37/304 |

FOREIGN PATENT DOCUMENTS

| | | | |
|---|---|---|---|
| DE | 10 2014 205 368 | A1 | 9/2015 |
| DE | 10 2015 000 447 | A1 | 7/2016 |

* cited by examiner

WASHING MACHINE AND METHOD OF CONTROLLING THE WASHING MACHINE

BACKGROUND OF THE INVENTION

1. Field of the Invention

The present disclosure is concerned with a washing machine and a method of controlling the washing machine.

2. Description of the Prior Art

Modern washing machines for private use are increasingly equipped with a suitable sensor system for determining one or more laundry-related parameters on the basis of which a control unit of the washing machine influences one or more operating parameters of the washing machine, for example the wash time, the amount of water used, the amount of detergent used, the water temperature and the like. With regard to the prior art, reference is made in this connection to DE 10 2014 205 368 A1. A significant laundry-related parameter for example, the fabric type of the laundry that is to be washed. When determining the fabric type, more absorbent fabrics are to be distinguished from less absorbent fabrics. The more absorbent a fabric, the more water must be used overall for the washing operation, because a larger amount of water is required to soak the laundry than is the case with less absorbent fabrics. The total water consumption is nowadays an important criterion in the ecological and economic evaluation of washing machines.

Using the controls of a washing machine, the user is usually able to choose between different wash programs, which take account of the material of the laundry at least in part (for example, one wash program for wool, one for silk, one for cotton, etc.). It can be assumed that a silk wash program, for example, is generally used by users only for silk products, and that items of laundry made of silk generally have only comparatively low absorbency for water, regardless of the specific type of garment. However, other wash programs are often used by users for laundry of very different types. For example, a cotton wash program is used not only for pure cotton laundry but also for laundry with a proportion of synthetic fibers or laundry made wholly of synthetic fibers or fiber blends. Differences in absorbency are found even in the case of the material used for stitching. In addition, there is the type of weave, which can likewise result in differences in absorbency according to the loop size, for example. Toweling, for example, is considerably more absorbent than fabrics which are used, for example, for T-shirts or socks. In view of this, the simple selection of "cotton" by a user on the control panel of a washing machine is not sufficient to provide the control unit of the washing machine with information about the actual absorption behavior of the laundry loaded into the machine.

SUMMARY OF THE INVENTION

It is an object of embodiments of the present invention to provide a method of controlling a washing machine in which the laundry to be washed can be determined in respect of its absorbency by sensors.

It is a further object of embodiments of the present invention to provide a washing machine of the top loader type which uses such a method.

It is yet a further object of embodiments of the present invention to provide a washing machine which does not require a level sensor to determine the absorbency of laundry to be washed.

According to embodiments of the present invention there is provided a method of controlling a washing machine. The washing machine comprises a washing drum which is arranged suspended relative to a machine housing via a plurality of carrier arms and, in association with at least one of the carrier arms, a force sensor which supplies a sensor signal that is representative of the tensile force acting on the carrier arm in question. The method comprises: obtaining measurement information during each of a plurality of phases of a program run of the washing machine, wherein the measurement information is representative of a signal profile over time of the sensor signal over at least a portion of a revolution of the wash drum; introducing a defined amount of water into the wash drum between each pair of successive phases of the plurality of phases; determining parameter information indicative of the fabric type of laundry loaded into the wash drum, on the basis of the measurement information obtained during the various phases; and controlling the program run of the washing machine in dependence on the determined parameter information.

Carrier arms for suspending a wash drum in a machine housing of a washing machine are typically found in machines of the so-called top loader type. In this type of machine, the wash drum is mounted to be rotatable about a vertical axis of rotation, wherein a loading aperture for loading the wash drum with laundry is provided in the top side of the washing machine. The wash drum is in turn mounted in a container (often called a barrel) to which the carrier arms are fastened. The top loader type is commonly distinguished from the so-called front loader type, in which the wash drum is mounted to be rotatable about a horizontal axis of rotation and the loading aperture is provided in a front side of the washing machine.

In some embodiments, the measurement information of at least one of the phases represents a signal profile over time of the sensor signal over a complete revolution of the wash drum.

In some embodiments, the defined amount of water is introduced into the wash drum when the wash drum is stationary. It is thus conceivable, for example, that the wash drum is stopped between each pair of successive phases in order to introduce the defined amount of water into the wash drum.

In some embodiments, the defined amount of water is introduced into the wash drum in a locally concentrated manner when seen in the circumferential direction of the wash drum, that is to say is not distributed evenly over the circumference of the drum. Assuming that the amount of water introduced is absorbed at least in part by the laundry in the wash drum, this manifests itself as a local change in the signal amplitude of the sensor signal as compared with the situation before introduction of the defined amount of water. It is possible to draw conclusions regarding the absorption behavior of the laundry in the wash drum from the change in the signal profile of the sensor signal over a revolution of the drum.

In some embodiments, a first of the plurality of phases in terms of time is a phase after the start of the program run but before a phase for wetting the laundry loaded into the wash drum. In these embodiments, the first phase in terms of time is a phase in which the laundry loaded into the wash drum is still dry. Dry here means that the loaded laundry has not yet been deliberately wetted by the introduction of water into the wash drum. It also includes situations in which the laundry was already wet when loaded.

In some embodiments, the plurality of phases comprises at least two phases in which the laundry loaded into the wash drum is wet in part. A last of the phases in terms of time is in some embodiments a phase before the laundry in the wash drum has been soaked fully. After the laundry has been soaked fully, a further addition of water into the wash drum does not change or does not substantially change the signal profile over time of the sensor signal during a revolution of the wash drum, except to shift the sensor signal by an offset which is substantially constant over the entire revolution of the drum.

In some embodiments, a last of the plurality of phases in terms of time is a phase in which not more than 8 liters or not more than 7 liters or not more than 6 liters or not more than 5 liters or not more than 4 liters or not more than 3 liters or not more than 2 liters of water have been introduced into the wash drum since the start of the program run.

In some embodiments, the defined amount of water is not more than 3 liters or not more than 2.5 liters or not more than 2 liters or not more than 1.5 liters. In some embodiments, the defined amount of water is not less than 0.5 liter or not less than 0.7 liter or not less than 0.9 liter. Provided the plurality of phases includes three or more phases, the defined amount of water introduced between each pair of successive phases can be constant for all pairs or different for at least a partial number of the pairs.

In some embodiments, determining the parameter information comprises: for each of at least two of the plurality of phases, determining an amplitude difference of the sensor signal within a revolution of the wash drum on the basis of the determined measurement information of the phase in question; and comparing the determined amplitude differences of the at least two phases.

The amplitude difference is in some embodiments a minimum-maximum difference of the sensor signal. It is conceivable that the sensor signal exhibits a plurality of local maxima or/and a plurality of local minima within a revolution of the drum in at least one of the phases.

The amplitude difference can then be formed, for example, between the greatest local maximum (corresponding to a global maximum) and the smallest local minimum (corresponding to a global minimum) of the phase in question. Comparing the determined amplitude differences can include calculating a difference value between the amplitude differences. It is also conceivable that a plurality of amplitude differences is determined for the plurality of phases in each case by means of the local maxima and the local minima. For comparing this plurality of determined amplitude differences, two corresponding amplitude differences can then be assigned to one another by means of signal processing.

Within the context of the mentioned signal processing it is conceivable to count local maxima and local minima of the respective phases and to determine the amplitude values thereof. It is consequently then possible, on a time basis, to compare a local maximum/minimum of a phase with a local maximum/minimum of another phase.

In some embodiments, obtaining the measurement information for at least one of the phases comprises: determining a plurality of sample values of the sensor signal during a revolution of the wash drum; and determining a plurality of auxiliary signal values of the sensor signal on the basis of the determined sample values, wherein each auxiliary signal value is determined by averaging or forming the median of a different partial number of sample values. Averaging or forming the median allows the influence of any interfering signals to be reduced or suppressed.

On the basis of the sensor signal of the force sensor it is possible not only to obtain information about the absorption behavior of the loaded laundry but also to determine the weight of the loaded laundry. The weight determination can also be expedient for precise control of the program run of the washing machine. The less laundry has been introduced, the less water can be required for the washing operation. In some embodiments, obtaining the measurement information for at least two of the phases therefore comprises: determining a plurality of sample values of the sensor signal during a revolution of the wash drum. In these embodiments, the method further comprises: determining weight information on the basis of the measurement information obtained during the at least two phases, wherein the determination of the weight information comprises: determining a resulting signal profile over time on the basis of the measurement information obtained during the at least two phases; and analyzing a constant component and also an alternating component of the resulting signal profile over time.

According to a further aspect, the present disclosure provides a washing machine comprising: a machine housing; a wash drum arranged suspended relative to a machine housing via a plurality of carrier arms; in association with at least one of the carrier arms, a force sensor which supplies a sensor signal that is representative of the tensile force acting on the carrier arm in question; and a control unit which is connected to the force sensor and is configured to effect the execution of the following steps: obtaining measurement information during each of a plurality of phases of a program run of the washing machine, wherein the measurement information is representative of a signal profile over time of the sensor signal over at least a portion of a revolution of the wash drum; introducing a defined amount of water into the wash drum between each pair of successive phases of the plurality of phases; determining parameter information indicative of the fabric type of laundry loaded into the wash drum, on the basis of the measurement information obtained during the various phases; and controlling the program run of the washing machine in dependence on the determined parameter information.

According to some embodiments, the washing machine is free of a sensor which detects the water level in the wash drum. For example, the washing machine is free of a pressure sensor and/or a fill level sensor which detects the water level in the wash drum. A pressure sensor here means, for example, a sensor which in the wash drum measures a pressure exerted by a water column on an air column.

Embodiments of the present invention are described below with reference to the accompanying drawings.

DETAILED DESCRIPTION OF THE EMBODIMENTS

Figure 1:
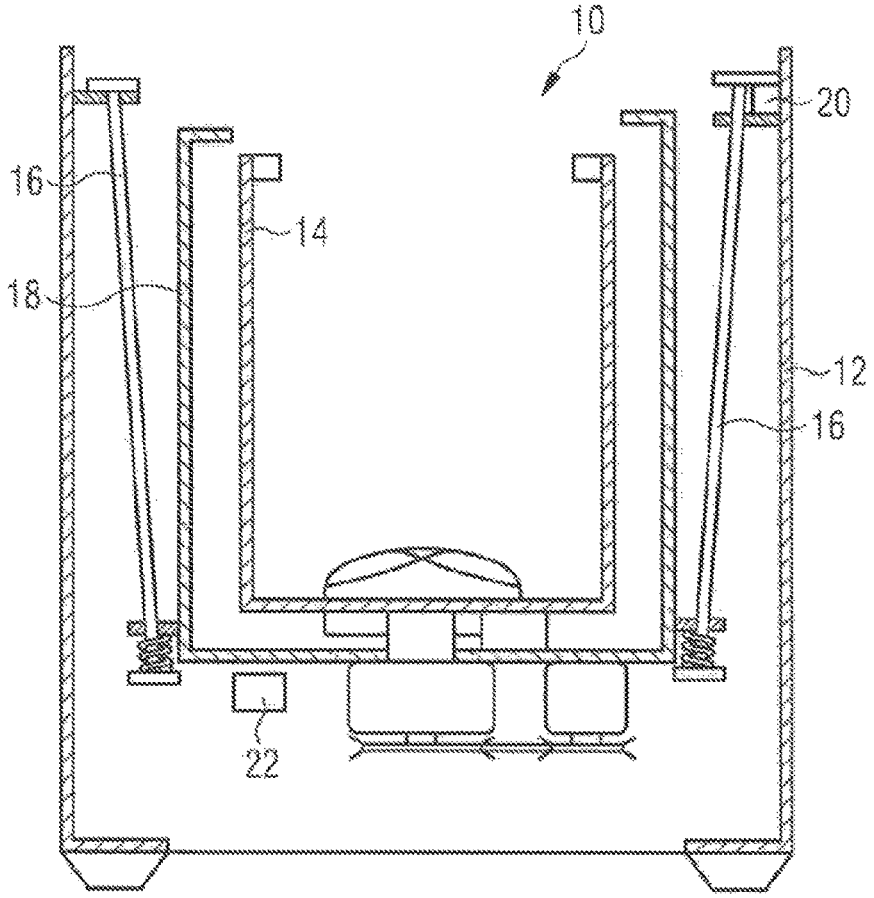
FIG. 1 is a schematic cross-sectional view of a washing machine according to some embodiments.

Reference is first made to FIG. 1. The washing machine shown therein is designated generally 10. It comprises a machine housing 12 and a wash drum 14 which is arranged suspended relative to the machine housing 12 via a plurality of carrier arms 16. In the example shown, the wash drum 14 is not connected directly to the carrier arms 16. Instead, the washing machine 10 further comprises a barrel 18 in which the wash drum 14 is arranged and which is connected to the carrier arms 16 via corresponding bearing elements.

One of the carrier arms 16 shown in FIG. 1, of which the washing machine 10 described by way of example has a total of four (only two are shown in the sectional view according to FIG. 1), is equipped with a force sensor 20. An example of a form of the force sensor 20 can be found in DE 10 2015 000 447 A1, the content of which is incorporated herein by reference. The force sensor 20 supplies an output signal (also called a force sensor signal in the following) which is representative of a tensile force acting on the carrier arm 16 in question equipped with the force sensor 20. According to some embodiments, the output signal generated by the force sensor 20 is representative of a tensile force exerted on the carrier arm 16 by the wash drum 14 via the barrel 18. This means that the output signal of the force sensor 20 generally does not represent the absolute value of the force exerted by the wash drum but merely the component of the force that is taken up by the carrier arm 16 on which the force sensor 20 is arranged. The absolute force value can then be deduced taking account of the number of carrier arms 16 used (4 in the example shown, 3 or 5 or another suitable number of carrier arms 16 also being possible). The force sensor 20 is here arranged by way of example in the region of an upper end of the carrier arm 16. It is, however, also conceivable to arrange the force sensor in the lower region (in the region where the carrier arm 16 is connected to the barrel 18). It is also possible for a plurality of the carrier arms 16, for example all four carrier arms, of the washing machine 10 to be provided with a force sensor 20.

The washing machine 10 shown in FIG. 1 is a washing machine of the top loader type. This means that the washing machine 10, when it is placed for conventional use on a floor, has an upward facing reclosable opening (loading aperture) through which a user can load laundry to be washed into the wash drum 14. This also means that the wash drum 14 rotatably arranged in the barrel 18 rotates during operation of the washing machine 10 about an axis of rotation which runs orthogonally to an upper and a lower side of the washing machine housing 12.

The washing machine 10 further comprises an electronic control unit 22 (also called a control unit in the following) which processes the force sensor signal. The electronic control unit 22 is configured to control the program run of a wash program of the washing machine 10 in dependence on the signal profile over time of the force sensor signal. During operation of the washing machine 10, a washing operation can be divided into the operating phases of loading the wash drum 14 with laundry, wetting (merely dampening or also completely soaking) the laundry by the intake of water into the wash drum 14, washing the laundry in reversing operation, pumping water out of the wash drum 14, removing water from the laundry by spinning, and unloading the laundry from the wash drum 14. The electronic control unit 22 is configured to evaluate the force sensor signal during these operating phases and to control the program run of the washing machine 10 in dependence on the result of the evaluation. A corresponding method will be described hereinbelow with reference to FIGS. 2 to 6*b*.

Figure 2:
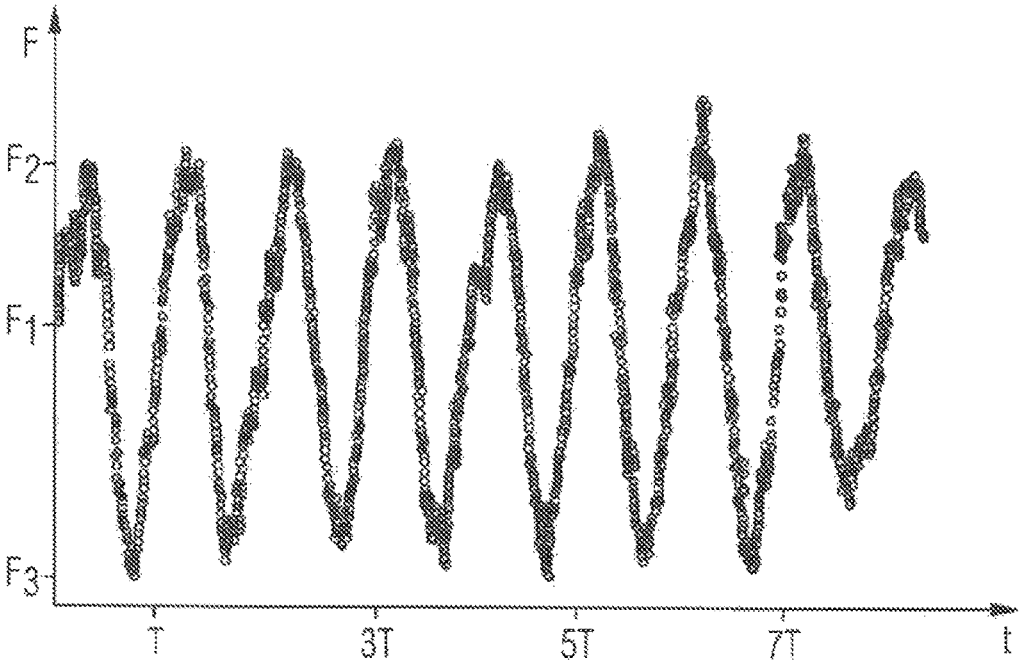
FIG. 2 shows an actual signal profile of a force sensor signal over time in the case of a plurality of complete revolutions of the wash drum according to a measurement result.

FIG. 2 shows, by way of example, an actual signal profile, as is obtained by evaluating the force sensor signal over a plurality of revolutions of the wash drum 14. A specific amount of laundry is thereby introduced into the wash drum 14 before the measurement. The time T indicates the time after which the wash drum 14 has performed a complete revolution, that is to say a revolution through 360°.

As can be seen in FIG. 2, the force sensor signal follows in good approximation a sinusoidal profile. At the beginning of the rotation of the wash drum 14, and thus of the measurement, a force level $F_1$ is obtained. The force level increases to $F_2$ at approximately a quarter turn of the wash drum 14, falls to $F_3$ at approximately a three-quarter turn and increases to force level $F_1$ again at the end of the first revolution of the wash drum 14. This signal profile of the force sensor signal is repeated virtually unchanged for the following revolutions. A periodicity in the signal profile of the force sensor signal is thus obtained.

The force peaks (force levels $F_2$ and $F_3$) visible in FIG. 2 occur because of an unequal weight distribution of the laundry inside the wash drum 14 in the circumferential direction thereof. This can be due, for example, to the fact that heavy items of laundry such as towels were loaded at one point in the circumferential direction of the wash drum 14, but lighter items of laundry such as T-shirts or socks were loaded at other points. A further reason for an unequal weight distribution of the laundry in the circumferential direction of the wash drum 14 can be that some of the laundry loaded into the wash drum 14 was already wet, and this laundry is heavier than other items of laundry due to the water absorbed by the laundry.

At the point in time at which, during a revolution of the wash drum 14, a heaviest point, seen in the circumferential direction of the wash drum 14, is located exactly at the level of the carrier arm 16 equipped with the force sensor 20, the highest force level $F_2$ (see FIG. 2) is established at the force sensor 20. If that heaviest point then moves, as a result of the rotation of the wash drum 14, towards a point which is diametrically opposite the carrier arm 16 equipped with the force sensor 20, the force level falls constantly until the lowest force level $F_3$ finally prevails at the level of the diametrically opposite point on the force sensor 20. If the wash drum 14 rotates further, the force level increases again until the value $F_2$ is reached again.

Figure 3A:
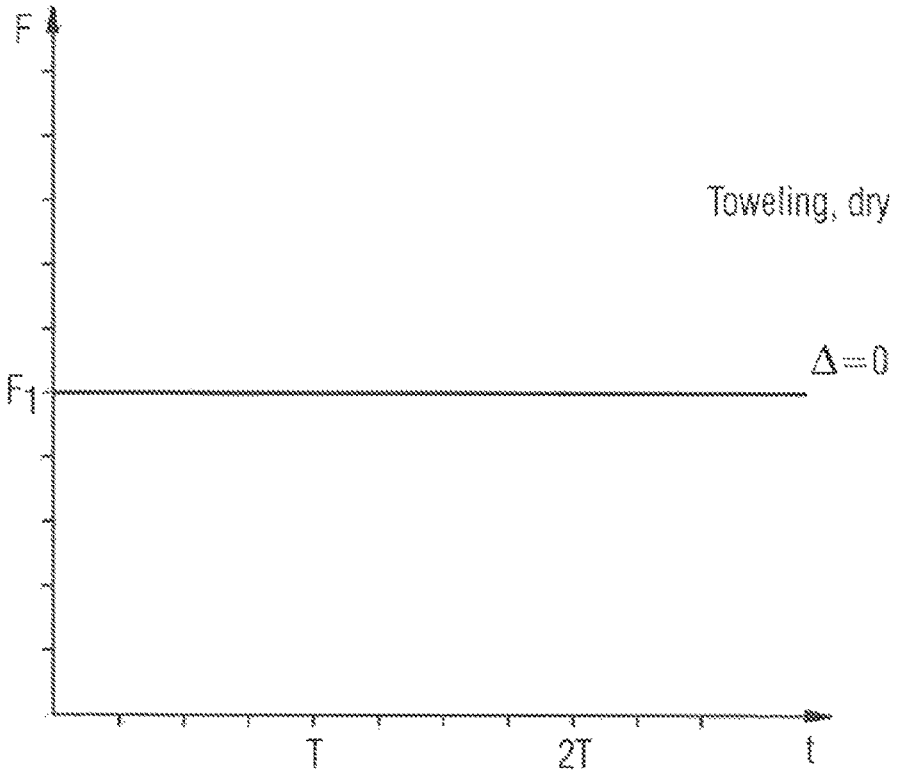
FIG. 3*a* shows an idealized, qualitative signal profile of a force sensor signal over time in the case of a washing machine loaded with dry toweling fabric.

In the following figures, the signal profiles of the force sensor signal, on the basis of the observations according to FIG. 2, inasmuch as there is an unequal weight distribution in the wash drum 14, are shown as idealized sinusoidal curves. It is immaterial whether the unequal weight distribution is the result of the unequal distribution of laundry in the circumferential direction of the wash drum 14 or, as is characteristic for some embodiments, arises because of the introduction of a specific amount of water into the wash drum 14 between two measuring phases. Centrifugal forces and moments which arise as a result of the rotation of the wash drum 14 during operation are disregarded, FIG. 3*a* shows, qualitatively, an idealized profile of the force sensor signal over time. The time T marked in FIG. 3*a* again corresponds to the time after which the wash drum 14 has completed a complete revolution (that is to say through 360°) about its axis of rotation. In contrast to the idealized signal profile shown in FIG. 3*a*, however, such a low-oscillation curve will not be formed in reality, that is to say various harmonics and signal peaks of the force sensor signal upwards and downwards will appear. Such outliers will arise for all the following examples and are to be seen, for example, in FIG. 2.

In the example shown in FIG. 3*a*, the wash drum 14 of the washing machine 10 has been filled by a user with a specific amount of dry toweling fabric. It is here assumed that the fabric was distributed evenly in the circumferential direction of the wash drum 14, that is to say a weight distribution of the fabric introduced in the circumferential direction does not vary or scarcely varies. The signal profile of the force sensor signal shown in FIG. 3*a* is obtained therefrom upon measurement. The signal profile of the force sensor signal consists of values sampled over time during one or more revolutions of the wash drum 14, which values represent a tensile force acting on the force sensor 20 at the time in question. If all the items of laundry of the loaded laundry are dry and if the laundry is distributed evenly in terms of weight in the circumferential direction of the wash drum 14, then the constant signal profile shown in FIG. 3*a*, which does not have a gradient at any point, is obtained. This value is representative of the weight of the laundry loaded into the wash drum 14.

According to some embodiments, the wash drum 14 performs at least one complete revolution (0 to T on the time axis in FIG. 3*a*), during which the signal profile of the force sensor signal is measured with the laundry dry. This a first of a plurality of phases of the program run of the washing machine 10, which begins after the start of the program run of the washing machine 10. The speed of rotation of the wash drum 14 can thereby be, for example, as in all the other of the plurality of phases, 100 revolutions per minute. However, the method is not limited thereto. Accordingly, the speed of rotation of the wash drum 14 during the measurement of the signal profile can alternatively also be 50 revolutions per minute or 200 revolutions per minute or another suitable value, for example a value between the above-mentioned values.

Between the first and a second of the plurality of phases, a defined amount of water is introduced into the wash drum 14. This is carried out, effected by the control unit 22, via a water inlet which is not shown in FIG. 1. The water inlet is in any case arranged in the machine housing 12 above the wash drum 14. The water inlet is further so arranged that the defined amount of water is introduced into the wash drum 14 as far as possible from the axis of rotation in a plane which is orthogonal to the axis of rotation of the wash drum 14.

The defined amount of water is generally introduced when the wash drum 14 is stationary. This means that, at the time the defined amount of water is introduced, the wash drum 14 is not rotating about the axis of rotation or is rotating only very slowly about the axis of rotation in comparison with the speed that prevails during reversing operation or during spinning operation. The defined amount of water is thus introduced into the wash drum 14 in a locally concentrated manner when seen in the circumferential direction of the wash drum 14. By means of the introduction of the defined amount of water, at least some of the laundry, which is located directly beneath the water inlet when the defined amount of water is introduced, is wetted. After this wetting, a signal profile over time of the force sensor signal over a complete revolution of the wash drum 14 is again measured during the second of the plurality of phases.

Figure 3B:
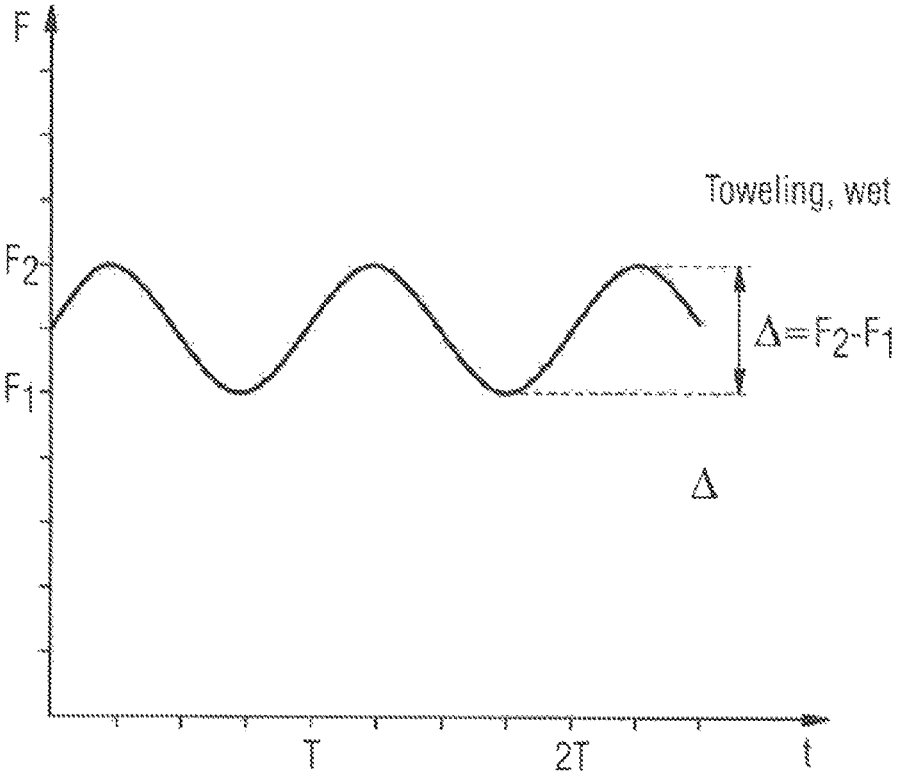
FIG. 3*b* shows an idealized, qualitative signal profile of the force sensor signal over time in the case of the same load of the washing machine as in FIG. 3*a* and after a defined amount of water has been introduced.

FIG. 3*b* shows the effect of the introduction of the defined amount of water between the first and the second phase on the signal profile of the force sensor signal during a revolution of the wash drum 14.

It can clearly be seen that, in comparison with the curve shown in FIG. 3*a*, the signal profile that remains constant at a value is no longer obtained here. Instead, there are similarities with the signal profile of an actual measurement shown in FIG. 2. The force sensor signal increases continuously to the maximum force level $F_2$ at a quarter turn of the wash drum 14 and falls to the minimum force level $F_1$ at the time of a three-quarter turn of the wash drum 14. After the wash drum 14 has rotated through 360°, that is to say at time T, the force level is at the starting value again. There is thus obtained here a maximum force level (maximum value) $F_2$, which arises as a result of the water introduced between the phases. The minimum force level $F_1$ corresponds to the force level before the water is introduced.

If FIGS. 3*a* and 3*b* are compared, the change in shape of the signal profile of the force sensor signal allows conclusions to be drawn regarding the absorbency of the laundry located in the wash drum 14, more precisely regarding the fabric type of which the laundry is made. In each of the examples shown in FIGS. 3*a* and 3*b*, the material in the wash drum 14 is highly absorbent. In FIGS. 3*a* and 3*b*, the material is given as being toweling, but it can also be cotton or any other highly absorbent material. If the defined amount of water is then introduced between the phases in a locally concentrated manner and as far as possible towards a side edge of the wash drum 14, the amount of water at the location in question on the circumference of the wash drum 14 is taken up or absorbed by the laundry located there. The corresponding portion of the laundry then has, compared with a time before the water was introduced, an increased weight due to the absorbed water. If the wash drum 14 is then rotated through 360°, the maximum value $F_2$ will then be established as mentioned above in relation to FIG. 2 when the portion of the laundry which has absorbed the water introduced is located at the closest possible point to the force sensor 20. If that portion moves towards the point which is closest to the force sensor 20, the force will increase, which is indicated here in FIG. 3*b* by the positive gradient of the signal profile of the force sensor signal. In the opposite case, a negative gradient of the signal profile of the force sensor signal is obtained when the portion of the laundry which has absorbed the water introduced moves away from the point which is closest to the force sensor 20 again.

The control unit 22 of the washing machine 10 is configured to obtain measurement information from these signal profiles and, on the basis of this measurement information, to determine parameter information which is characteristic of the fabric type (here, for example, toweling) of laundry loaded into the wash drum 14. This can be effected, for example, by determining and comparing amplitude differences which occur in the force sensor signal within a revolution of the wash drum 14.

For the example shown in FIGS. 3*a* and 3*b*, this means that the fabric type here is highly absorbent. In FIG. 3*a*, no force differences appear over the full revolution of the wash drum 14 on the basis of the idealized curve, in which it is assumed that the dry laundry is distributed evenly over the circumference of the wash drum 14. By contrast, a maximum force level appears in FIG. 3*b* (in the case of a complete revolution of the wash drum 14 with partially wetted laundry) at a quarter turn of the wash drum 14. The force $F_2$ acting on the force sensor 20 here is greater than the force $F_1$ acting constantly on the force sensor 20 in the case of FIG. 3*a*. However, if the portion of the laundry that has absorbed the amount of water introduced is located at a point diametrically opposite the force sensor 20, the force $F_1$ will be established here too, as indicated in FIG. 3*b* after a three-quarter turn of the wash drum 14.

An amplitude difference Δ can be calculated from the minimum force and the maximum force of a signal profile. Accordingly, for the curve in FIG. 3*a* a value $\Delta=0$ is obtained, since the force $F_1$ is applied constantly to the force sensor 20 over the revolution of the wash drum 14 and thus no amplitude difference occurs. For the curve in FIG. 3*b*, a value $\Delta=F_2-F_1$ is obtained. By comparing the two amplitude differences it is finally possible to deduce the parameter information that is representative of the absorption behavior of the introduced laundry and thus of the fabric type of the laundry. This parameter information can be a difference between the two amplitude differences, for example. Generally, a large difference between the two amplitude differences, as here in the case of FIGS. 3*a* and 3*b*, indicates high absorbency of the laundry loaded into the wash drum 14. Conversely, a small difference between the two amplitude differences will generally indicate low absorbency of the laundry loaded into the wash drum 14.

The parameter information can accordingly be a single numerical value which represents the absolute difference between the amplitude differences determined during the respective phases. This value can then be used to control the program run of the washing machine 10 and can be compared, for example, with a threshold value stored in a memory of the washing machine 10.

Figure 4A:
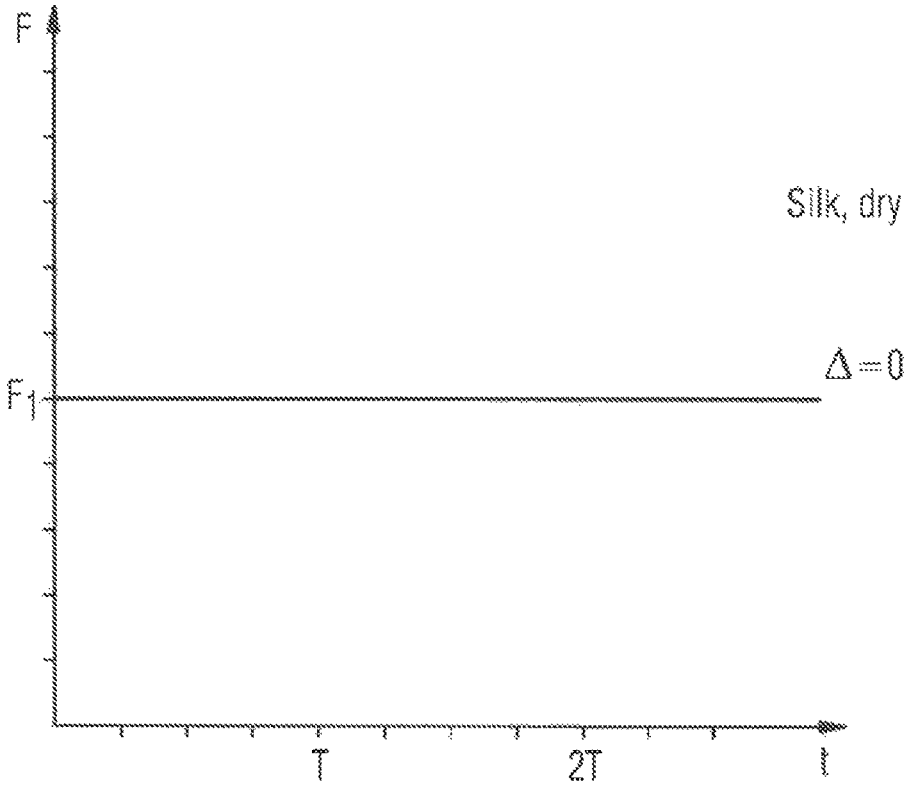
FIG. 4*a* shows an idealized, qualitative signal profile of the force sensor signal over time in the case of a washing machine loaded with dry silk.
Figure 4B:
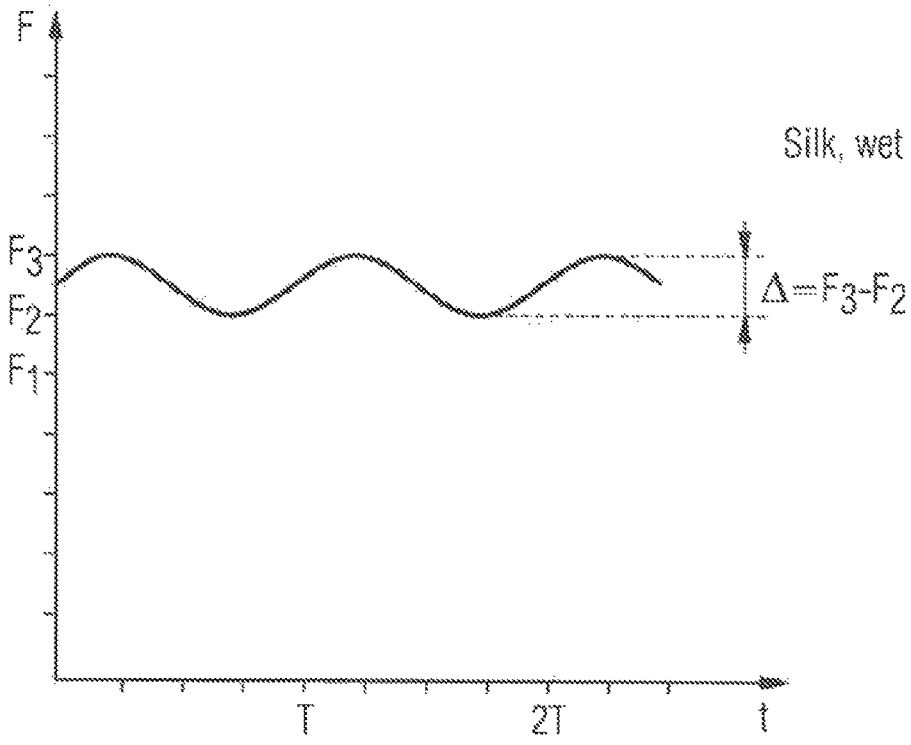
FIG. 4*b* shows an idealized, qualitative signal profile of the force sensor signal over time in the case of the same load of the washing machine as in FIG. 4*a* and after a defined amount of water has been introduced.

According to a further example, FIGS. 4*a* and 4*b* again show signal profiles over time of the force sensor signal over two complete revolutions of the wash drum 14. In contrast to FIGS. 3*a* and 3*b*, laundry with low absorbency was here introduced into the wash drum 14. The material can be silk, as indicated in FIGS. 4*a* and 4*b*. Alternatively, the material can also be polyester or any other material with low absorbency, it is again assumed that the laundry, as far as weight is concerned, is distributed evenly in the circumferential direction of the wash drum 14. For this reason, the same profile is obtained in FIG. 4*a* as in FIG. 3*a*. When the wash drum 14, loaded with dry silk, revolves through 360°, the idealized profile of the force sensor signal does not have any gradients but instead remains constant at a force level $F_1$.

Since silk has only low absorbency, the water introduced into the wash drum 14 between the phases is absorbed by the laundry in the wash drum 14 to only a small extent in the example in FIGS. 4*a* and 4*b*. The remainder of the defined amount of water which is introduced into the wash drum 14 via the water inlet runs through the laundry and is distributed evenly in the bottom of the wash drum 14. Consequently, when the wash drum 14 is revolved again, there will be a smaller difference between the maximum and minimum pressure level as compared with the result from FIG. 3*b*. A further difference compared with measurement with highly absorbent toweling fabric is that the minimum force level $F_2$ of the force sensor signal after introduction of the water is higher than the force level $F_1$ of the force sensor signal before introduction of the water. The reason for this is the portion of the water introduced into the wash drum 14 that is distributed evenly in the bottom of the wash drum 14 and thus generally raises the force level. The offset of the sinusoidal force sensor signal is thus displaced upwards when the entire amount of water introduced is not absorbed by the laundry, since the portion of the water that is not absorbed by the laundry is always reflected equally in the force sensor signal, independently of the rotational position of the wash drum 14.

The oscillation in the force sensor signal which occurs in FIG. 4*b* in addition to the offset is caused by the water absorbed by the silk and the resulting unequal weight distribution of the laundry in the circumferential direction of the wash drum 14. As mentioned, the oscillation in FIG. 4*b* is smaller in comparison with the oscillation in FIG. 3*b* since the silk located in the wash drum 14 is able to absorb the water introduced to only a small degree. With regard to the amplitude differences of the force sensor signals, the same considerations apply as above in the context of FIGS. 3*a* and 3*b*. However, the smaller difference here indicates the low absorbency of the laundry located in the wash drum 14.

In addition to the absorbency of the laundry, the comparison between the signal profiles of the force sensor signals before and after the introduction of water resulting from the additional weight of the water introduced is indicative of the amount (volume) of water introduced itself. This can be effected, for example, by subtracting the signal profiles before and after the introduction of water into the wash drum 14 from one another. Such a subtraction results in a signal profile which is representative of the tensile force exerted on the force sensor 20 by the water introduced between the phases. In this manner, a precise determination of the weight and consequently—by means of the density of the water—of the volume of the water introduced into the wash drum 14 between the phases is possible. The amount of water introduced will generally vary between a minimum value of 0.5 liter and a maximum value of 3 liters.

If, for example, there is an amount of 5 kg of laundry evenly distributed in the washing machine 10 before the water is introduced, a constant force sensor signal F1 (see FIGS. 3*a* and 3*b*) of 1.25 kg is obtained over a rotation of the wash drum 14 through 360° for the case where the wash drum 14 is suspended via a total of four carrier arms 16 arranged at 90° intervals. The mean of this signal is thus 1.25 kg. In order to obtain the absolute force value (5 kg), however, the mean must be taken into account four times because of the four mountings. If 2 kg of laundry are now introduced from the side, that is to say at the edge of the wash drum 14, and measurement is then carried out again, a sinusoidal force sensor signal is obtained which moves between 1.25 kg and 2.25 kg in the course of a revolution of the wash drum 14. The force sensor signal thereby has a constant component F1 of 1.25 kg. An alternating component F2, F3 fluctuates between 0 kg and 1 kg in the course of a revolution. If the signal profile measured before the introduction of the water is subtracted from the signal profile measured after the introduction of the water, the signal profile representative of the tensile force of the water is obtained. In the present example, there remains only the alternating component of the signal profile measured after the introduction of water, which, as mentioned, fluctuates between 0 kg and 1 kg over the revolution. Owing to the four mountings in the present case, the amplitude difference of this alternating component must be multiplied by two in order to deduce the weight force exerted by the water. This means that, in the present example, a value characteristic of the weight of the water introduced of (1 kg−0 kg)*2=2 kg is obtained. By contrast, a remaining constant component F1, for example if all the water introduced is not absorbed by the laundry, would have to be multiplied by the factor of four in the case of four mountings in order to deduce the value characteristic of the weight of the water introduced. Accordingly, in the case of a mixture of remaining constant component/alternating component, the minimum-maximum difference of the alternating component F2, F3 multiplied by the factor two is added to the constant component F1 multiplied by the factor 4.

In the examples shown in FIGS. 3*a*/3*b* and 4*a*/4*b*, two successive phases are shown in each case. However, the method according to the invention is not limited thereto. In fact, it is possible to obtain the measurement information during three or four or five or more successive phases, between each of which a defined amount of water is introduced into the wash drum 14. This amount does not always have to be the same amount but can also vary, for example, between the first and second or the second and third phase or between other phases.

In the examples of FIGS. 3*a* to 4*b*, it has been assumed that the laundry is distributed evenly in the circumferential direction when it is introduced into the wash drum 14. However, the method is not limited thereto. In some embodiments, it is conceivable that there is already an unequal weight distribution in the circumferential direction of the wash drum 14 after the laundry has been introduced into the wash drum 14, that is to say before the first of the plurality of phases. Apart from the reasons already mentioned, this can happen, for example, as a result of the laundry being introduced unevenly into the wash drum 14, that is to say being pressed together more at one or more specific points in the circumferential direction than at other points.

Figure 5A:
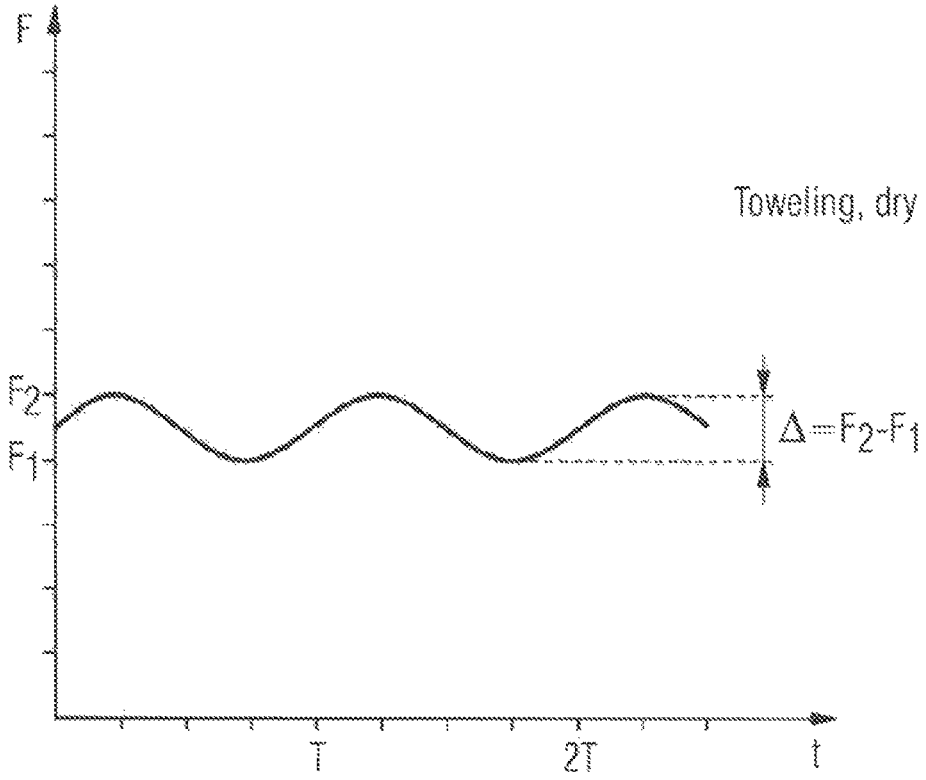
FIG. 5*a* shows an idealized, qualitative signal profile of the force sensor signal over time in the case of a washing machine loaded with toweling fabric distributed unevenly in the circumferential direction of the wash drum.

FIG. 5*a* shows by way of example a signal profile over time of the force sensor signal when dry laundry of the toweling fabric type has been introduced into the wash drum 14 and the laundry, when introduced, was pressed together more in a particular region on the circumference of the wash drum 14 than in the remaining regions of the wash drum 14. For this reason, there are force differences over a complete revolution of the wash drum 14 even while the measurement information is being obtained, before the defined amount of water is introduced into the wash drum 14. At the point in time (in FIG. 5*a* at approximately a quarter turn of the wash drum 14) at which the point of wash drum 14 in the circumferential direction at which the washing is most pressed together is closest to the force sensor 20, a maximum force value $F_2$ is obtained. There is an amplitude difference $\Delta=F_2-F_1$ between a maximum and a minimum value of the force sensor signal even when measurement is carried out with dry laundry.

If measurement is carried out again after the defined amount of water has been introduced, the amplitude difference thus changes in dependence on the position in the circumferential direction of the wash drum 14 at which the water is introduced. The important factor here is the relative phase position, that is to say an angular offset between the region (which within the context of this disclosure is assumed in an idealized manner to be a point) in the circumferential direction of the wash drum 14 at which the laundry is most pressed together, and the point in the circumferential direction of the wash drum 14 at which the water is introduced between the phases. According to the angular offset, the amplitude difference of the force sensor signal before introduction of the water will change to differing degrees in comparison with the amplitude difference of the force sensor signal after introduction of the water. This is illustrated below with reference to FIGS. 5*b* to 5*d*.

Figure 5B:
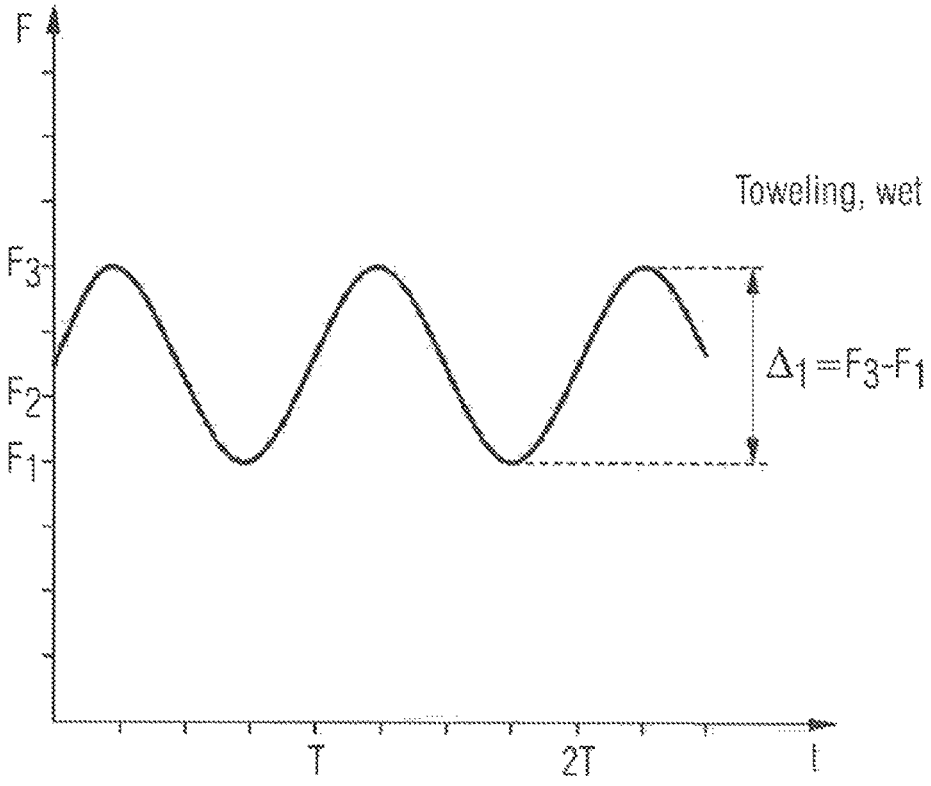
FIG. 5*b* shows an idealized, qualitative signal profile of the force sensor signal over time in the case of the same load of the washing machine as in FIG. 5*a* and after a defined amount of water has been introduced.

In the example shown in FIG. 5*b*, the water is introduced exactly at the point at which the laundry in the wash drum 14 is most pressed together. The relative phase position is accordingly zero. As a result, both the offset of the signal profile of the force sensor signal and the maximum force values thereof increase in FIG. 5*b* as compared with FIG. 5*a* (from $F_2$ in FIG. 5*a* to $F_3$ in FIG. 5*b*), but the minimum force values remain at the same level $F_1$.

If parameter information indicative of the fabric type, or absorbency, of the laundry introduced into the wash drum 14 is now to be deduced, this is again possible, owing to the identical phase position of the water introduced and of the point at which the laundry is most pressed together, via a comparison of the amplitude differences (see in this connection the comments made in relation to FIGS. 3*a* and 3*b*), which were determined both in the case of measurement with dry laundry and in the case of measurement with wet laundry.

Figure 5C:
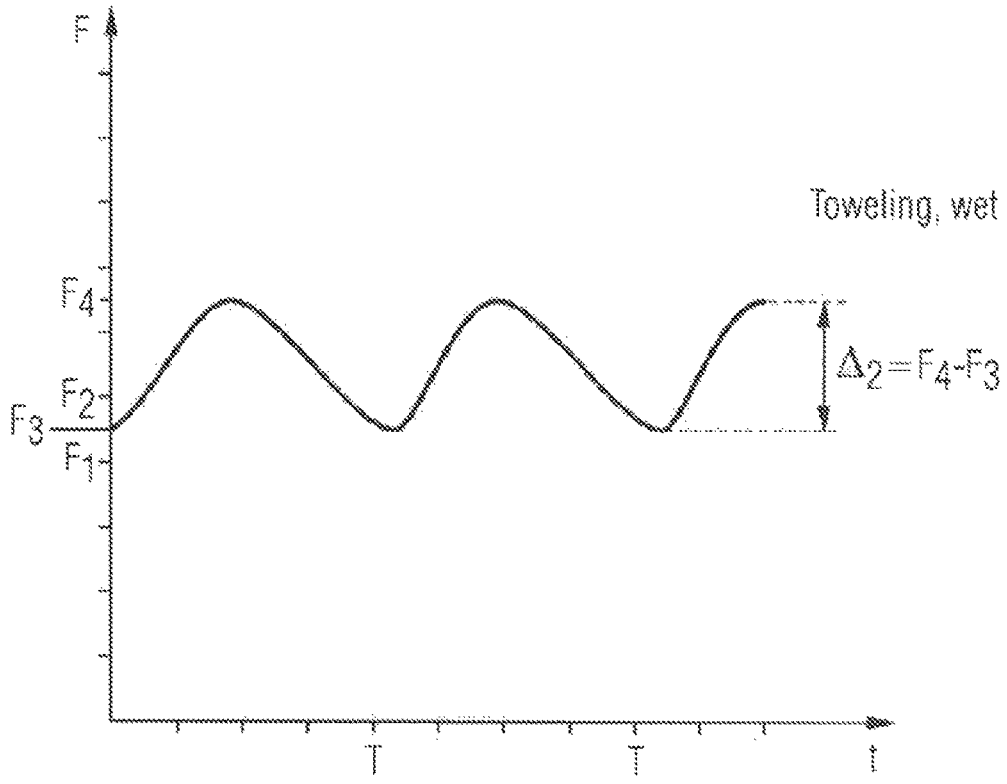
FIG. 5*c* shows a further idealized, qualitative signal profile of the force sensor signal over time in the case of the same load of the washing machine as in FIG. 5*a* and after a defined amount of water has been introduced.

FIG. 5*c* shows a case in which the phase position of the water introduced and of the point at which the laundry is most pressed together differ by 90°, that is to say by a quarter turn of the wash drum 14. The respective sinusoidal force sensor signals thus do not lie exactly above one another in relation to an absolute rotational position of the wash drum 14. The shape of the resulting curve in FIG. 5*c* differs from the ideal sinus shape owing to the phase shift. This leads to a smaller amplitude difference Δ, even though an equal amount of water was introduced into the wash drum 14 onto the same load as in the example in FIG. 5*b*. For the signal profile in FIG. 5*c*, $\Delta_2=F_4-F_3<\Delta_1$. There are no differences, however, as regards the means of the respective signal profiles and thus also as regards the offsets relative to the force signal profile from FIG. 5*a*, that is to say before introduction of the water. In such a case, it is no longer sufficient to compare the amplitude differences of the respective force sensor signals before and after the introduction of water. Rather, the phase position between the water introduced and the point at which the laundry is most pressed together must also be taken into consideration.

In some embodiments, it is conceivable that the washing machine 10 has a rotary angle sensor (not shown in FIG. 1) for this purpose. The force sensor signal can thus be determined not only in a time-resolved manner but also in relation to an absolute rotational position of the wash drum 14. Signal profiles determined in relation to the rotational position of the wash drum 14 during different phases can then be superimposed in dependence on the absolute rotational position and compared with one another. In this manner, it is in turn possible to obtain the parameter information, which is characteristic of the fabric type of the laundry introduced into the wash drum 14, by comparing the amplitude differences (see in this connection the comments made in relation to FIGS. 3*a* and 3*b*), which were determined both in the case of measurement with dry laundry and in the case of measurement with wetted laundry.

Figure 5D:
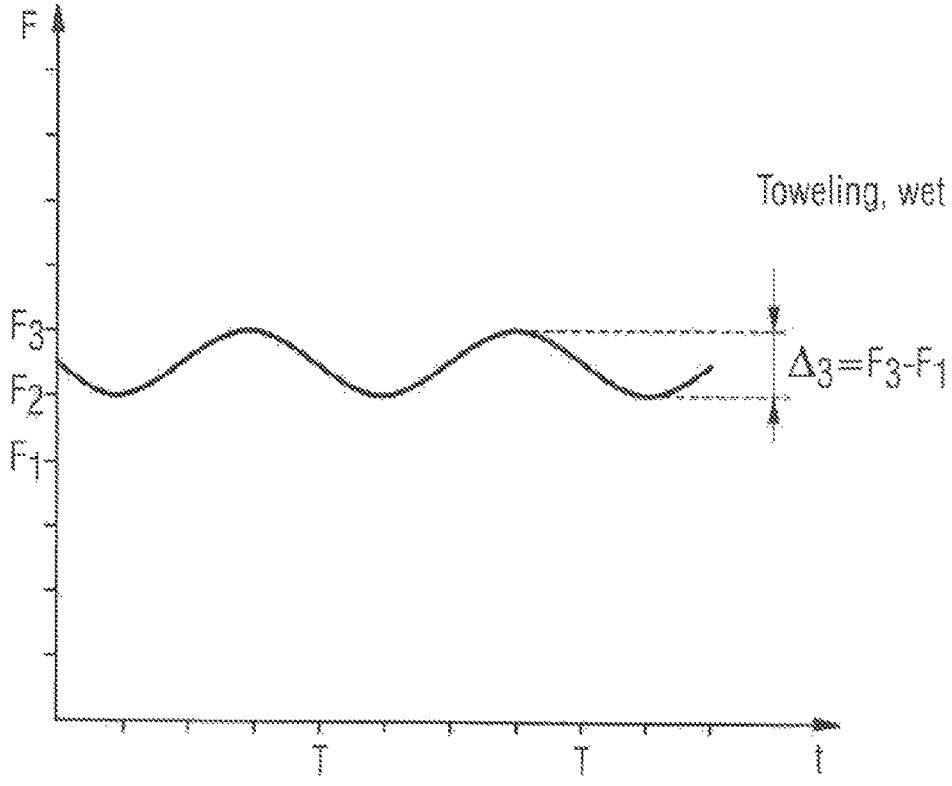
FIG. 5*d* shows a further idealized, qualitative signal profile of the force sensor signal over time in the case of the same load of the washing machine as in FIG. 5*a* and after a defined amount of water has been introduced.

In some embodiments, it can happen that, for example in the case of a highly absorbent fabric type, the defined amount of water is introduced exactly at a point in the circumferential direction of the wash drum 14 at which there was a minimum force level during the measurement before the introduction of water. This corresponds to a relative phase position between the water introduced and the point at which the laundry is most pressed together of 180°, that is to say a half turn of the wash drum 14. Such an example is shown in FIG. 5*d*. A kind of destructive interference occurs here as a result of the phase shift. Even though the same amount of water has been introduced into the wash drum 14 onto the same load as in the example in FIGS. 5*b* and 5*c*, this leads to a smaller amplitude difference Δ than in the signal profiles of the mentioned figures. For the signal profile in FIG. 5*d*, $\Delta_3=F_3-F_1<\Delta_2<\Delta_1$. There are no differences, however, as regards the means of the respective signal profiles and thus also as regards the offsets in relation to the force signal profile of FIG. 5*a*, that is to say before introduction of the water.

In this case too it is necessary—identically to the case shown in FIG. 5*c*—to compare the amplitude differences of the respective force sensor signals before and after the introduction of water, taking account of the phase position between the water introduced and the point at which the laundry is most pressed together.

For this purpose, it is necessary that the control unit 22 knows the relative phase position. Within the context of the described method, it is conceivable, but not essential, using the above-described rotary angle sensor, that an absolute rotational position of the wash drum 14 is detectable and/or controllable as the starting point for the measurements of the signal profiles of the force sensor signals. In some embodiments, only signal profiles over time of the force sensor signal over a complete revolution of the wash drum 14 can be measured. The respective measurement curves can then be analyzed by corresponding signal processing by means of the control unit 22 and superposed so that identical corresponding rotational positions (equivalent to a relative phase position of zero) of the wash drum 14 are obtained for specific points in time of the signal profiles of the force sensor signal during the different phases. The measurement curves determined before and after the introduction of water into the wash drum 14 are thus synchronized with one another.

The last measurement point of the measurement before introduction of the water into the wash drum 14 can provide a starting point for the synchronization of two profiles of the force sensor signal. That measurement point at the same time corresponds to the first measurement point of the measurement after the introduction of the water into the wash drum 14. Accordingly, two measured values (dry and wet) are known in relation to this one rotational position. When the measuring frequency with which the force sensor signal is recorded and the speed of the wash drum 14 are identical in the case of both measurements, the profile of the force sensor signal measured before introduction of the water can thus be synchronized with the profile of the force sensor signal measured after the introduction of water. However, because of the sinus shape of the signal profiles, there are two measurement points of the measurement before introduction of the water as potential synchronization points for the first measurement point of the measurement after introduction of the water. In order to ensure that the synchronization takes place at the correct one of the two potential synchronization points, the control unit 22 can determine, by analyzing the signal before introduction of the water, whether the signal has a positive gradient or a negative gradient in a section before the potential synchronization point. A corresponding gradient is then also to be expected in the signal which is measured after the introduction of water. In this manner, a clear allocation of the measurement points for the synchronization of the signal profiles can take place.

At different measurement frequencies and/or speeds, corresponding conversions and, where appropriate, interpolations must first be carried out before the synchronization.

As mentioned, the described examples start from an idealized sinus profile of the force sensor signal, the frequency of which corresponds to the speed of the wash drum 14. At low speeds (up to several hundred revolutions per minute) and when no strong acceleration forces act on the wash drum 14, this assumption corresponds with good approximation to actual conditions. However, if a further oscillation occurs, for example owing to an imbalance of the wash drum 14, the frequency of which does not correspond to the speed of the wash drum 14, it is no longer possible to start from such an idealized signal profile.

For a non-idealized signal profile, a plurality of local maxima and minima characteristic of this signal profile can occur during a measurement. Because of the increased number of inflection points in the signals, the above-described steps for synchronization therefore have only limited applicability. However, by means of a detailed evaluation (detection of the amplitudes and frequencies of these local maxima and minima and their time intervals), it is possible to synchronize the time-resolved signals with one another. However, this will not be discussed in greater detail here.

Figure 6A:
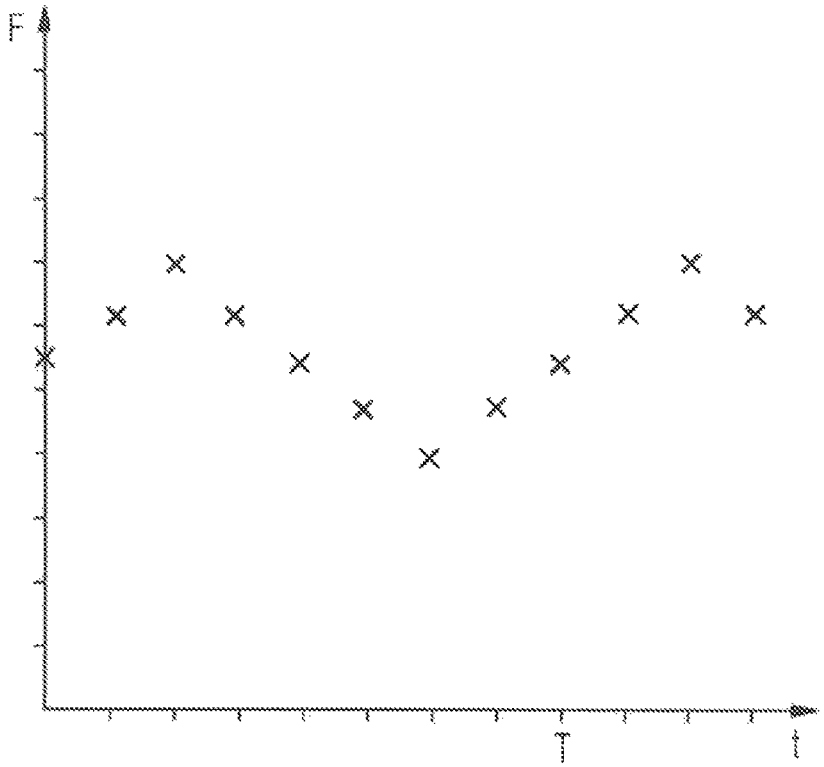
FIG. 6*a* shows, by way of example, a plurality of sample values of the force sensor signal over time.
Figure 6B:
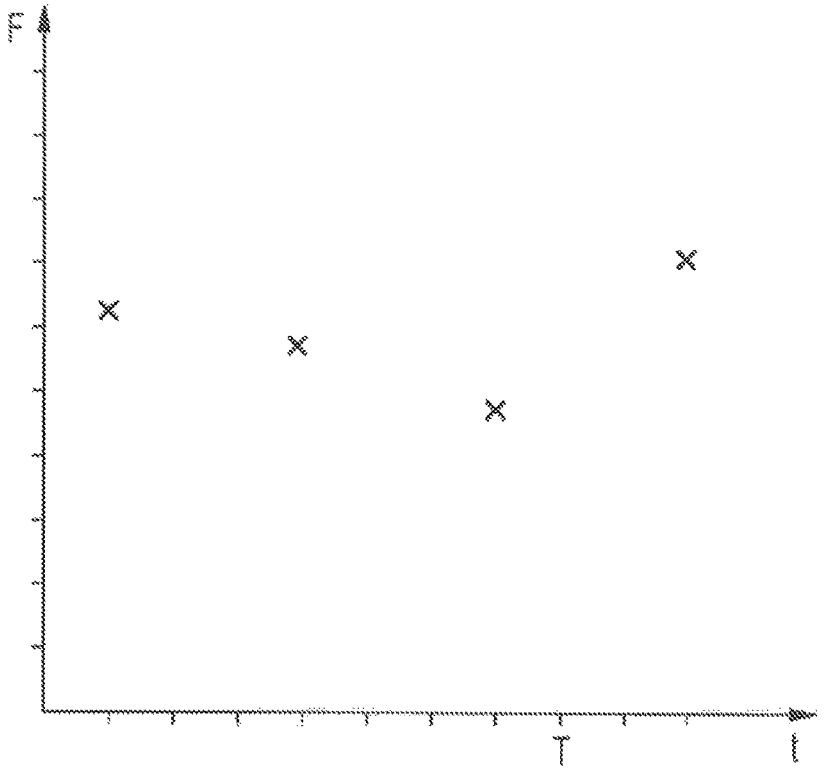
FIG. 6*b* shows, by way of example, auxiliary signal values of the force sensor signal determined from the plurality of sample values shown in FIG. 6*a*.

FIGS. 6*a* and 6*b* show an example of a possible way in which the measurement information obtained during a phase can be filtered. This can be used to filter out, or at least reduce, interfering signals, for example high-frequency force peaks (see FIG. 2), from the signal profile over time of the force sensor signal. In FIG. 6*a*, all the detected sample values of the force sensor signal are plotted over a specific time (There again characterizes a complete revolution of the wash drum 14). FIG. 6*b*, on the other hand, shows how an auxiliary signal value of the force sensor signal is formed from three successive sample values of FIG. 6*a*. In the example shown, the auxiliary signal value is formed by forming an arithmetic mean of the three corresponding sample values. However, the disclosed method is not limited thereto. It is also possible, for example, to form a moving mean over the sample values in order to produce the auxiliary signal values. In this case, the auxiliary signal values are not determined by different sample values, but the sample values used to form the means can partially overlap. It is likewise conceivable, instead of forming the mean, to form a median over a specific number of adjacent sample values as the auxiliary signal values.

An example of the mentioned filtering would be to sample the force sensor 20 at 500 Hz, that is to say with 500 measured values per second. Ten adjacent measured values could then be averaged to form an auxiliary signal value. An auxiliary signal profile over time with a correspondingly lower frequency, in the present example 50 Hz, would then be obtained from these auxiliary signal values. All the method steps described above can then also be carried out using the auxiliary signal profile over time of the sensor signal.

In the preceding examples, it has always been assumed that the signal profile of the force sensor signal is measured during a complete revolution of the wash drum 14. In this case, the wash drum 14 performs a revolution through 360° during each of the plurality of phases. However, it is also conceivable as an alternative that one or more of the phases consist of more than one complete revolution of the wash drum 14. For example, it is conceivable that the force sensor signal during one phase is measured over 10 or over 50 or over 100 or over 500 revolutions of the wash drum 14. An averaged profile of the force sensor signal over 360° can then be used to determine the parameter information. This gives a further possible way of filtering the force sensor signal in order at least to attenuate measured values (force peaks) which are not representative of the signal.

On the basis of the determined parameter information, a program run of the washing machine 10 can be controlled, as mentioned at the beginning. It is thus possible that the electronic control unit 22 sets or/and adjusts at least one operating parameter of the wash program of the washing machine 10 on the basis of the parameter information indicative of the fabric type of laundry loaded into the wash drum 14. Such an operating parameter can be, for example, an amount of water to be supplied, a profile over time of the supply of washing water, that is to say an optionally time-dependent flow rate of the water introduced into the wash drum 14, a movement of the wash drum 14 such as a speed, a direction of rotation and/or a speed profile, as well as a duration of reversing operation and/or of spinning operation. It is further conceivable to determine on the basis of the determined parameter information a recommendation for an amount of detergent to be supplied to the washing process and to effect the outputting of this recommendation.

In some embodiments, it is possible to determine the parameter information for the fabric type of laundry loaded into the wash drum 14 shortly after the start of the program run of the washing machine 10. It is thereby possible to determine the fabric type of the laundry located in the wash drum 14 before the start of reversing operation or/and before the start of spinning operation. In this manner, the above-mentioned operating parameters can be adjusted as early as possible in the program run of the washing machine 10.

In some embodiments, it is possible that the washing machine 10 does not require a sensor which detects the water level in the wash drum 14, for example a pressure sensor or fill level sensor, for determining some or all of the operating parameters necessary for the program run. In this manner, it is possible to monitor the operating parameters during a program run efficiently and inexpensively.

Although the preferred embodiments of the present invention are described herein, the above description is merely illustrative. Further modifications of the invention disclosed herein are familiar to the person skilled in the art, and all such modifications are to be regarded as lying within the scope of protection of the invention, as is defined by the accompanying claims.

What is claimed is:

1. A method of controlling a washing machine (10) which comprises a wash drum (14) arranged suspended relative to a machine housing (12) via a plurality of carrier arms (16) and, in association with at least one of the carrier arms, a force sensor (20) which supplies a sensor signal that is representative of a tensile force acting on the at least one carrier arm, wherein the method comprises:

obtaining measurement information during each of a plurality of phases of a program run of the washing machine, wherein the measurement information is representative of a signal profile over time of the sensor signal over one revolution or less of the wash drum;

introducing a defined amount of water into the wash drum between each pair of successive phases of the plurality of phases;

determining parameter information indicative of the fabric type of laundry loaded into the wash drum on the basis of the measurement information obtained during the plurality of phases, wherein determining parameter information comprising:

comparing signal profiles over time of the sensor signal of the plurality of phases; and determining the fabric type based on a change of the signal profile over time of the sensor signal between different ones of the plurality of phases; and controlling the program run of the washing machine in dependence on the determined parameter information.

2. The method as claimed in claim 1, wherein the measurement information of at least one of the phases represents a signal profile over time of the sensor signal over a complete revolution of the wash drum (14).

3. The method as claimed in claim 1, wherein the defined amount of water is introduced into the wash drum (14) when the wash drum is stationary.

4. The method as claimed in claim 1, wherein the defined amount of water is introduced into the wash drum in a locally concentrated manner when seen in the circumferential direction of the wash drum (14).

5. The method as claimed in claim 1, wherein one of the plurality of phases is a phase after the start of the program run but before a phase of wetting the laundry loaded into the wash drum (14).

6. The method as claimed in claim 1, wherein the plurality of phases comprises at least two phases in which the laundry loaded into the wash drum (14) is at least partially wet.

7. The method as claimed in claim 1, wherein a last of the plurality of phases with respect to time is a phase in which not more than a specific amount of water has been introduced into the wash drum (14) since the start of the program run, and wherein the specific amount of water is chosen from the group consisting of 2 liters, 3 liters, 4 liters, 5 liters, 6 liters, 7 liters, and 8 liters.

8. The method as claimed in claim 1, wherein the defined amount of water is one of: not more than 3 liters, or not more than 2.5 liters, or not more than 2 liters, or not more than 1.5 liters.

9. The method as claimed in claim 1, wherein the defined amount of water is chosen from the group consisting of not less than 0.5 liter, not less than 0.7 liter, and not less than 0.9 liter.

10. The method as claimed in claim 1, wherein the determination of the parameter information comprises:

for each of at least two of the plurality of phases, determining an amplitude difference of the sensor signal within a revolution of the wash drum (14) on the basis of the determined measurement information of the phase in question;

comparing the determined amplitude differences of the at least two phases.

11. The method as claimed in claim 10, wherein the amplitude difference is a minimum-maximum difference of the sensor signal.

12. The method as claimed in claim 1, wherein obtaining the measurement information for at least one of the phases comprises:

determining a plurality of sample values of the sensor signal during a revolution of the wash drum (14);

determining a plurality of auxiliary signal values of the sensor signal on the basis of the determined sample values, wherein each auxiliary signal value is determined by averaging or forming the median of a different partial number of the sample values.

13. A washing machine (10) comprising:

a machine housing (12);

a wash drum (14) arranged suspended relative to the machine housing via a plurality of carrier arms (16);

in association with at least one of the carrier arms, a force sensor (20) which supplies a sensor signal that is representative of a tensile force acting on the at least one of the carrier arms;

a control unit (22) which is connected to the force sensor and which is configured to effect the execution of the following steps:

obtaining measurement information during each of a plurality of phases of a program run of the washing machine, wherein the measurement information is representative of a signal profile over time of the sensor signal over one revolution or less of the wash drum;

introducing a defined amount of water into the wash drum between each pair of successive phases of the plurality of phases;

determining parameter information indicative of the fabric type of laundry loaded into the wash drum on the basis of the measurement information obtained during the plurality of phases, wherein determining parameter information comprising:

comparing signal profiles over time of the sensor signal of the plurality of phases; and determining the fabric type based on a change of the signal profile over time of the sensor signal between different ones of the plurality of phases; and controlling the program run of the washing machine in dependence on the determined parameter information.

14. The washing machine (10) as claimed in claim 13, wherein the washing machine is free of a sensor that detects the water level in the wash drum (14).

* * * * *